United States Patent [19]

Lohr

[11] 4,441,719

[45] Apr. 10, 1984

[54] BALLOON GAME

[76] Inventor: Raymond J. Lohr, 5043 Sterrettania Rd., Erie, Pa. 16506

[21] Appl. No.: 297,703

[22] Filed: Aug. 31, 1981

Related U.S. Application Data

[63] Continuation-in-part of Ser. No. 23,612, Mar. 26, 1979, abandoned.

[51] Int. Cl.[3] ..... A63B 63/02

[52] U.S. Cl. ..... 273/402

[58] Field of Search ..... 273/317, 318, 319, 331, 273/348, 402, 357, 398, 399

[56] References Cited

U.S. PATENT DOCUMENTS

| | | | |
|---|---|---|---|
| 422,575 | 3/1890 | Doty | 273/402 |
| 2,042,424 | 5/1936 | Estes | 273/402 |
| 2,504,818 | 4/1950 | Findon | 273/402 |
| 3,039,770 | 6/1962 | Ferretti | 273/402 X |
| 3,201,126 | 8/1965 | Nissen | 273/402 X |
| 3,339,925 | 9/1967 | Nissen | 273/402 |
| 4,295,648 | 10/1981 | Stromback | 273/402 X |

FOREIGN PATENT DOCUMENTS

| | | | |
|---|---|---|---|
| 1460951 | 10/1966 | France | 273/398 |

*Primary Examiner*—Paul E. Shapiro

*Attorney, Agent, or Firm*—Charles L. Lovercheck; Wayne L. Lovercheck; Dale R. Lovercheck

[57] ABSTRACT

A balloon game having a target made up of two laterally spaced frame members held in spaced relation to each other, a balloon, and a paddle for each player. The frame members have an operative to permit the passage of the balloon and are spaced sufficiently to narrow the effective target area through which the balloon may pass. The balloon is a conventional type of inflated spherical child's balloon, blown to a size that allows it to float, and fall slowly. The paddles are of a conventional type presenting a flat area to impact the balloon and a handle area to be grasped by the player. The target has a knock-down construction for easy storage and quick assembly.

12 Claims, 7 Drawing Figures

BALLOON GAME

CROSS REFERENCE TO RELATED APPLICATION

This application is a continuation-in-part of an application of the same inventor and title, Ser. No. 023,612 filed Mar. 26, 1979, now abandoned.

BACKGROUND OF THE INVENTION

The invention relates to the field of games and more particularly to the field of games involving moving an object ball from court to court through an obstacle.

The game disclosed herein constitutes an improvement over the British Pat. No. 1,293,468 and the following U.S. Pat. Nos. 3,711,095; 2,042,424; 3,819,182; 4,210,326; 422,575; 3,339,925; 3,039,770; 4,188,031; 1,958,892; 3,201,126; 2,504,818. Great Britain Pat. No. 1,293,468.

SUMMARY OF THE INVENTION

A game having a target made up of two laterally spaced frame members held in spaced relation to each other, a balloon, and a paddle for each player. The frame members have an aperture or target area to permit the passage of the balloon and are spaced sufficiently to narrow the effective target area through which the balloon may pass. The balloon is a conventional type of inflated spherical child's balloon, blown to a size that allows it to float, and fall slowly. The paddles are of a conventional type presenting a flat area to impact the balloon and a handle area to be grasped by the player. The target has a knock-down construction for convenient storage and quick assembly.

It is an object of the invention to provide an improved game.

Another object of the invention is to provide an active game that can be played in a minimum of space.

Another object of the invention is to provide a barrier game that can be used indoors or outdoors and which requires a minimum of equipment to be played.

Another object of the invention is to provide a game of skill which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENTS

Figure 1:
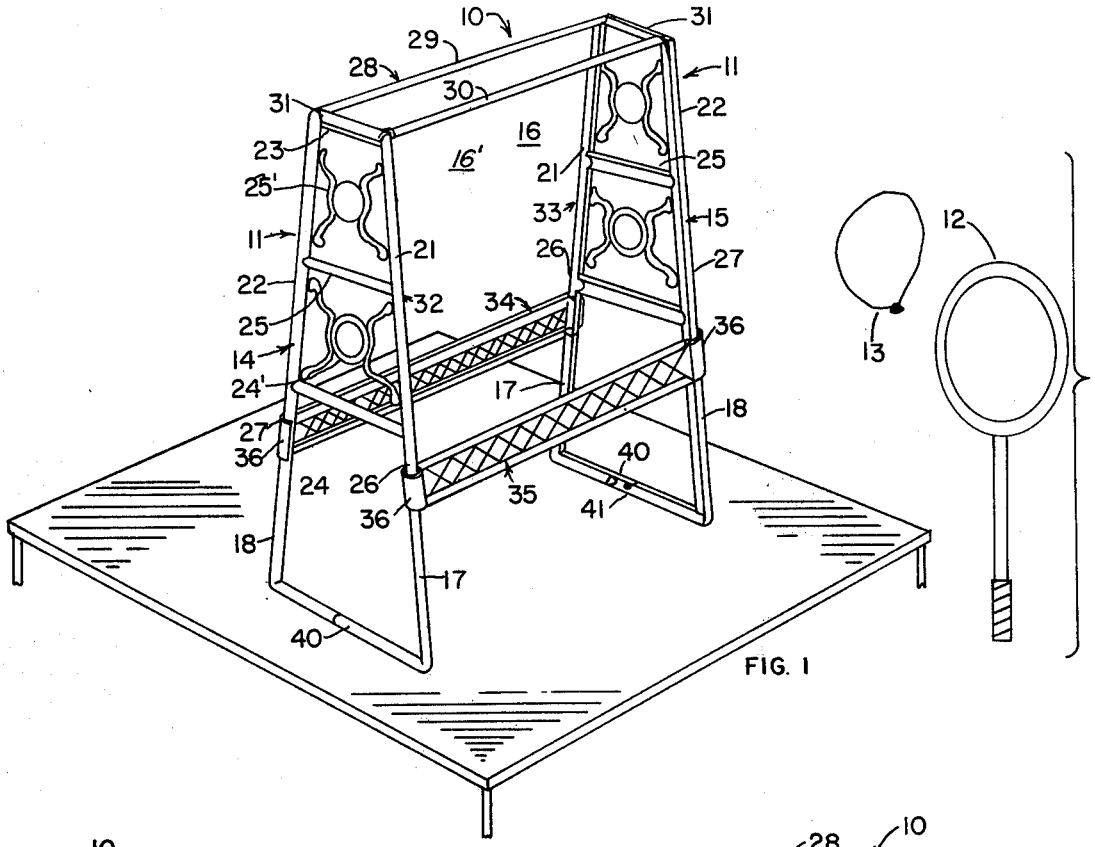
FIG. 1 is an isometric view of the game according to the invention showing a first embodiment of the target, a paddle and a balloon.

The game, according to the invention, is played with the target set on a card table or similar table. Players have three strokes to return the balloon through the target but they may use fewer strokes. Failure to return the balloon, or the balloon hitting the floor scores a point for the opponent.

The game may also be played with the target set on the floor, and the balloon is then permitted to bounce once off the floor before returning. The player still has three strokes to return the balloon. The serve and scoring is similar to table tennis. The server is permitted one fault without penalty. Two faults cost him a point. The player may not move the racket inside the area of the net or hit the net frame for which a point is awarded to the opponent. Two players may play on each side for "doubles" and the balloon should be blown up to 8 or 9 inches in diameter. Now, with more particular reference to the drawings, the game 10 is made up generally of a target 11, balloon 13, and at least one paddle 12. The balloon may be any of the inflatable rubber balloons that are well known and commonly used at picnics and county fairs, generally spherical in shape. The paddle may be any of the type of badminton paddles familiar to those skilled in the art and having a relatively long handle and a flat impact surface. However, the paddle could have a knitted impact surface and it could have a short handle as in a ping pong or similar paddle.

The target 11 could be any suitable material, but it is preferable that it be made of a molded plastic or wire in molded plastic. The target 11 is made up of a first frame member 14 and a second frame member 15. The first frame member encloses a target area 16 and the second frame member encloses a target area 16'. The frame members are horizontally spaced from each other and form the sides of a target area 16 through which the balloon must be propelled.

In a preferred embodiment the first frame member 14 comprises a first vertical member 21, a second vertical member 22, a first side 29 of top member 28, and bottom member 34 enclosing or bounding a first target area 16'. The second frame member 15 comprises another vertical member 21, another second vertical member 22, a second side 30 of top member 28, and bottom member 35. The first frame member 14 and the second frame member 15 have first support members 23 and 25 holding them in spaced relation to each other and second support members 17, and 18 holding them in spaced relation to the subjacent surface which may be a floor, table or card table for example. The first and second frame members and the first and second support members are divided into sections which reduce the structure to a convenient size for storage. The sections are provided with means for attaching together as further described herein which permit the easy set up and knock down of the target. The target area 16 and 16' is enclosed by the target 11 and is bounded by the first frame member 14 and the second frame member 15 on its sides, is bounded along it upper extreme by a top member 28 and is bounded along its lower extreme by a first bottom member 34 and a second bottom member 35.

Each frame member 14 and 15 comprise a first vertical member 21 and a second vertical member 22 spaced from each other and having support means therebetween which may consist of horizontal members attached therebetween. A first set of members may include upper support member 23, lower support member 24, intermediate support member 25 and decorative members 24' and 25' extending between the first vertical member 21 of frame member 14 and the second vertical member 22 of frame 15. A second set of members 23, 24, 25, 24', 25' exttends between the second vertical member 22 of frame 14 and the first vertical member 21 of frame 15. Horizontally disposed upper members 23, horizontally disposed lower members 24, and horizontally disposed intermediate members 25 are disposed between the vertical members and rigidly attached thereto. The frame members 14 and 15 may also have members 24' and 25' decoratively filling the space between vertical members 21 and 22.

The top member 28 extends horizontally between first frame member 14 and second frame member 15. The top member 28 has engaging members 31 at each end, which snap over the horizontally disposed upper members 23 and thereby forming an upper cross member of the target 11 which is easily detachable to take the frame apart and store it when not in use. The top member 28 has a first side 29 that forms the upper side of the first frame member and a second side 30 that forms the upper side of the second frame member. A first side member 32 and a second side member 33 are provided. The side members are constructed as described below. At each end of the top member 28 means for attaching the top member to the side members 32 and 33 are provided. The means for attaching may comprise an outwardly extending and generally arcuate engaging member 31 provided at each end of the top member. The outwardly extending engaging members 31 each enclose an area generally complimentary to the upper support member 23 and is adapted to frictionally engage the upper support member at each end of the top member. Thus, the top member may be readily attached to and detached from the side members 32 and 33.

First bottom member 34 and second bottom member 35 have engaging members 36 at each of their ends. The engaging members 36 snap over the first vertical member 21 and the second vertical member 22, at a point spaced from the top member 28 providing a target area 16 and 16' there between through which the balloon 13 may be propelled by the paddle 12. First side member 32 is located at a first end of the first and second frame members and consists of upper support member 23, first vertical member 21, second vertical member 22, intermediate support member 25, and lower support member 24. Second side member 33 is located at a second end of the first and second frame members and consists of upper support member 23, first vertical member 21, second vertical member 22, intermediate support member 25, and lower support member 24. At each end of the bottom members 34 and 35 means for attaching the bottom member to the side members are provided. The means for attaching may comprise outwardly extending and generally arcuate engaging members 36 provided at each end of the bottom members 34 and 356. Each engaging member enclosing an area generally complimentary to the vertical members 21 and 22 and is adapted to frictionally engage the vertical member at each end of the bottom member. Thus, the bottom member may be readily attached to and detached from the side members 32 and 33.

In a preferred embodiment to provide a target 11 which may be broken down for packaging and storage in a smaller box, the first vertical member 21 may terminate at a point where the engaging member 36 attaches to it and the first vertical member 21 may be provided with a leg 17 extending downwardly. The second vertical member 22 may terminate at a point where the engaging member 36 attaches to it. The second vertical member 22 may be provided with a leg 18 extending downwardly. The legs 17 and 18 terminate at their upper ends in reduced size sections providing shoulders 19. The first vertical members 21 at their distal ends 26 and the second vertical members 22 at their distal ends 27 rest on the shoulders 19. The engaging members 36 on the first bottom member 34 and the second bottom member 35 snap over the distal ends 26 and 27 of the first vertical member 21 and the second vertical member 22 respectively at the reduced size portion of the leg 17 and the leg 18. The engaging members 36 of the bottom members 34 and 35 firmly hold the vertical members 21 and 22 to the legs 17 and 18 and thereby provides a sturdy target 11.

Figure 2:
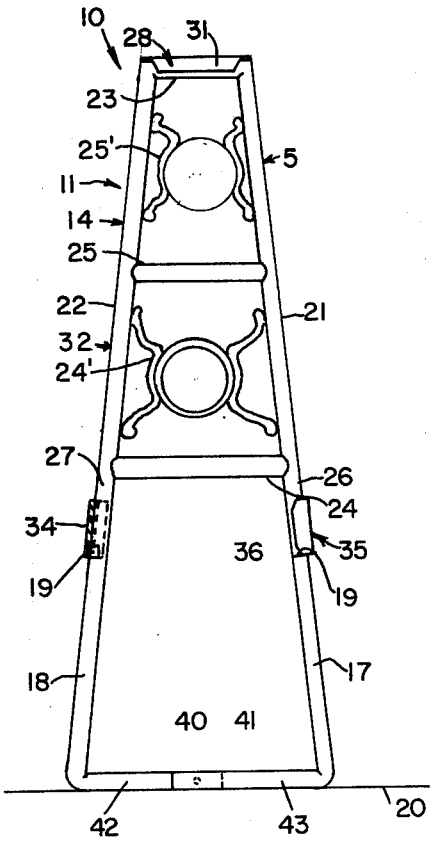
FIG. 2 is an end view partly in cross-section of the first embodiment of the target, sitting on a surface such as a floor or a card table.
Figure 3:
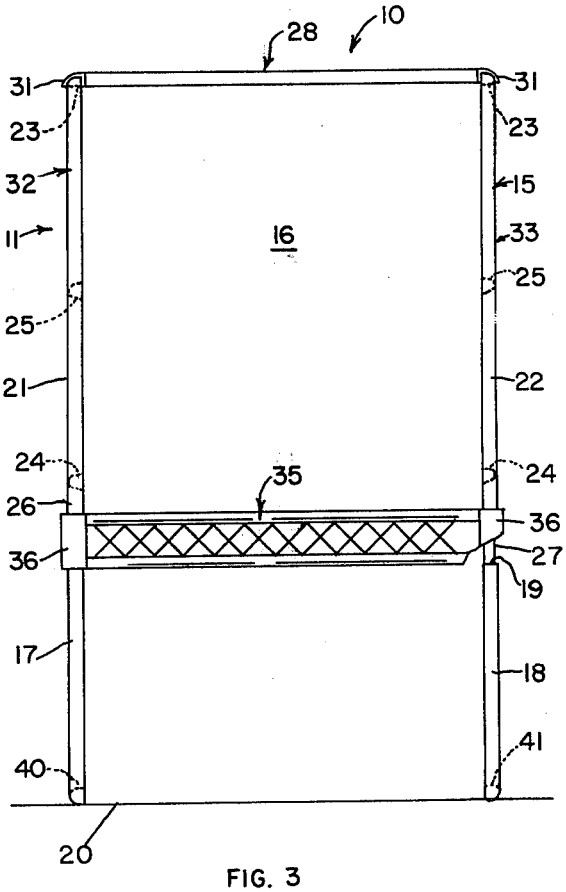
FIG. 3 is a side view of the game sitting on a surface such as a floor or a card table.
Figure 4:
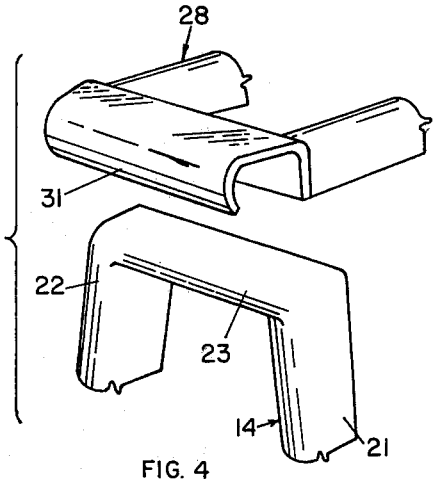
FIG. 4 is an enlarged partial view of a joint.
Figure 5:
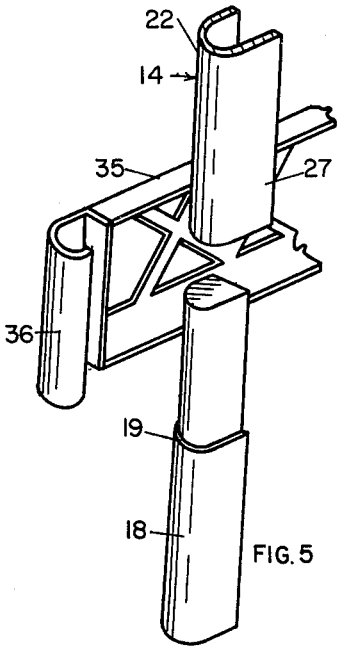
FIG. 5 is another enlarged partial view of another joint.
Figure 6:
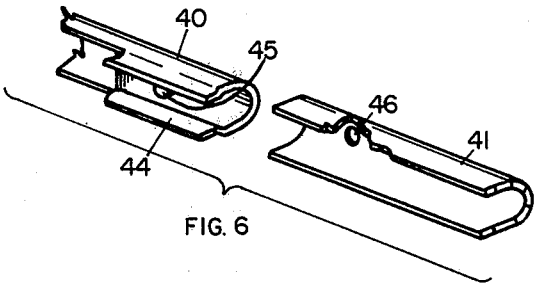
FIG. 6 is an enlarged partial view of a third joint.

The target 11 may be set on a surface such as a floor or, for additional height, a card table or other raised surface. The surface such as a floor or card table is indicated at 20 in FIG. 2 and FIG. 3. The leg 17, at its lower end, has a surface engaging member 43. The leg 18 at its lower end, has a surface engaging member 42. Leg 17 has an engaging end 40 having a peg 45 and an engaging member 44. Leg 18 has an engaging end 41 having a hole 46. The peg 45 pushes through the hole 46 thus holding the ends of the legs 17 and 18 in position relative to each other. The engaging member 44 snaps over the engaging end 41 to hold the legs 17 and 18 together.

In a preferred embodiment, the first frame member 14 and the second frame member 15 may be inclined toward each other to form a target 11 generally trapazoidal in shape in a side elevation, being wide at the bottom and narrow at the top to provide a steady base. In this embodiment each first vertical member 21 and each second vertical member 22 is inclined toward each other. Each upper member 23 is shorter than the lower member 24. Thus, the players can stand at either side of the frame and with the paddle or racquet 12, the players can try to knock the balloon back and forth through the target area opening 16. If the balloon is not struck exactly right, it may touch the side of either the first or the second frame member and fail to pass through, thus, requiring skill in the force and direction of striking the balloon.

An important rule of the game is to allow each player to strike the ball or balloon three times or less to get it through the net area. Another forbids the balloon from touching the floor.

The frame is designed to be light in weight of such a height as to be placed atop a card table of approximately 30" height for best playing action. This allows enough time before the balloon touches the floor to permit retrieval and return by the player.

For small children the game frame may be placed on the floor. In this case the rules are changed to allow the balloon to be bounced once off of the floor before return.

Figure 7:
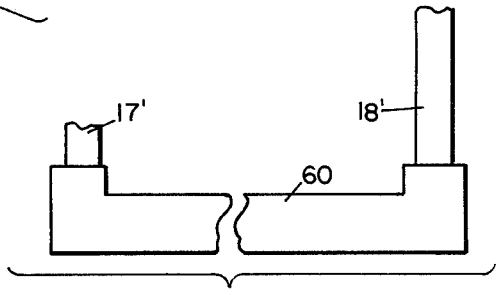
FIG. 7 is another embodiment of the a third joint.

In another embodiment the legs 17' and 18' could be tubular at their lower ends and adapted to engage member 60 which extends between legs 17' and 18' and is adapted to support said frame member 14 and 15, as shown in FIG. 7.

The foregoing speciication sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A game comprising, in combination,
a target, said target comprising a first frame member capable of being assembled to enclose a first area,
a second frame member capable of being assembled to enclose a second area,
said first frame member and second frame member being laterally spaced from each other,
said first area and said second area being adapted to permit a balloon to move therethrough,
support members,
said support members being adapted to support said first frame member and said second frame member in said spaced relation to each other,
a balloon,
said balloon being inflated sufficiently to cause it to move relatively slowly through the air and to drop slowly to the ground,
said first frame member, said second frame member and said support members comprising sections,
said sections including a top member, a first bottom member, a second bottom member, a first side member and a second side member,
means adapted to attach said top member to said first and second side members,
means adapted to attach first bottom member to said first and second side member,
means adapted to attach second bottom member to said first and second side member, whereby the sections may be assembled to form said target.

2. The game as recited in claim 1 wherein the side members each comprise an upper support member and a vertical member at each end thereof,
the means for attaching the top member to the first and second side members comprises:
engaging members affixed to the top member adjacent each of its ends,
each engaging member comprising an outwardly extending and generally arcuate member,
each outwardly extending engaging member forming a recess adapted to frictionally engage the upper support member of one of the side members.

3. The game as recited in claim 1 wherein the side members each comprise an upper support member and a vertical member at each end thereof,
the means for attaching the first and second bottom members to the first and second side members comprises:
engaging members affixed to the bottom members adjacent each of their ends,
each engaging member comprising an outwardly extending and generally arcuate member,
each outwardly extending engaging member forming a recess adapted to frictionally engage one of the vertical members of one of the side members.

4. The game as recited in claim 1 wherein the side members each comprise an upper support member and a vertical member at each end thereof,
the game further comprising:
legs,
the legs extend downwardly from each vertical member of each side member,
each leg having a reduced size section adjacent an upper end,
the reduced size section adapted to frictionally engage the lower end of each vertical member, whereby the target is supported on the legs and the legs extend the height of the target above the floor.

5. The game as recited in claim 4, wherein each leg has a lower surface engaging member,
the lower surface engaging members are adapted to be attached in pairs lying generally in a common plane with the side members,
the lower surface engaging member pairs being releasably attachable whereby a firm base for the target may be provided.

6. The game as recited in claim 4 wherein the bottom members engage the side members and the leg members engage the side members at generally the same position whereby a firm base for the target is provided.

7. A game to be played with a balloon and paddle comprising,
a target,
a balloon and a paddle,
said target comprising a top member, a first side member, a second side member, a first bottom member, and a second bottom member defining a space for said balloon to pass through when engaged by said paddle,
said bottom members being removably attached to and extending between said side members,
said top member being removably attached to and extending between said side members,
each of said side members comprising an upper support member, a first vertical member and a second vertical member,
means for attaching said bottom members to said side members,
means for attaching said top member to said side members.

8. A game to be played with a balloon and paddle as recited in claim 7, wherein the means for attaching the top member to the first and second side members comprises:
engaging members affixed to the top member adjacent each of its ends,
each engaging member comprising an outwardly extending and generally arcuate member,
each outwardly extending engaging member forming a recess adapted to frictionally engage the upper support member of one of the side members.

9. A game to be played with a balloon and paddle as recited in claim 7 wherein the means for attaching the first and second bottom members to the first and second side members comprises:
engaging members affixed to the bottom members adjacent each of their ends,
each engaging member comprising an outwardly extending and generally arcuate member,
each outwardly extending engaging member forming a recess adapted to frictionally engage one of the vertical members of one of the side members.

10. A game to be played with a balloon and paddle as recited in claim 7 further comprising:
legs,
the legs extend downwardly from each vertical member of each side member, each leg having a reduced size section adjacent an upper end, the reduced size section adapted to frictionally engage the lower end of each vertical member, whereby the target is supported on the legs and the legs extend the height of the target above the floor.

11. A game to be played with a balloon and paddle as recited in claim 10 wherein each leg has a lower surface engaging member, the lower surface engaging members are adapted to be attached in pairs lying generally in a common plane with the side members, the lower surface engaging member pairs being releasably attachable whereby a firm base for the target may be provided.

12. A game to be played with a balloon and paddle as recited in claim 10 wherein the bottom members engage the side members and the leg members engage the side members at generally the same position whereby a firm base for the target is provided.

* * * * *